US011370581B2

(12) United States Patent
Blubaugh

(10) Patent No.: US 11,370,581 B2
(45) Date of Patent: Jun. 28, 2022

(54) APPARATUS FOR SECURING A PACKAGE

(71) Applicant: Mail Bag Receiving and Protection System, LLC, Oklahoma City, OK (US)

(72) Inventor: Roland Ray Blubaugh, Oklahoma City, OK (US)

(73) Assignee: Mail Bag Receiving and Protection System, LLC, Oklahoma City, OK (US)

( * ) Notice: Subject to any disclaimer, the term of this patent is extended or adjusted under 35 U.S.C. 154(b) by 3 days.

(21) Appl. No.: 17/103,102

(22) Filed: Nov. 24, 2020

(65) Prior Publication Data

US 2021/0078769 A1 Mar. 18, 2021

Related U.S. Application Data

(63) Continuation of application No. 17/067,087, filed on Oct. 9, 2020, which is a continuation of application No. 16/291,837, filed on Mar. 4, 2019, now Pat. No. 10,800,577.

(60) Provisional application No. 62/637,820, filed on Mar. 2, 2018.

(51) Int. Cl.

| | |
|---|---|
| ***B65D 33/00*** | (2006.01) |
| ***G08B 13/12*** | (2006.01) |
| ***B65D 55/14*** | (2006.01) |
| ***B65D 25/20*** | (2006.01) |
| ***B65D 27/12*** | (2006.01) |

(52) U.S. Cl.

CPC ..... *B65D 33/00* (2013.01); *B65D 25/20* (2013.01); *B65D 27/12* (2013.01); *B65D 55/14* (2013.01); *G08B 13/126* (2013.01)

(58) Field of Classification Search

CPC .... G08B 13/126; G08B 13/128; B65D 25/00; B65D 25/20; B65D 27/00; B65D 27/12; B65D 27/20; B65D 27/30; B65D 33/00; B65D 33/02; B65D 55/14; A45C 15/00; A45C 15/06; A47G 29/20; A47G 29/30; F21V 33/00

See application file for complete search history.

(56) References Cited

U.S. PATENT DOCUMENTS

| | | | |
|---|---|---|---|
| 1,351,388 | A | 8/1920 | Kabaci |
| 1,847,969 | A | 3/1932 | Marks |
| 4,783,978 | A | 11/1988 | Vallerga |
| 4,785,960 | A | 11/1988 | Belisle |

(Continued)

*Primary Examiner* — Van T Trieu
(74) *Attorney, Agent, or Firm* — Dunlap Codding, P.C.

(57) ABSTRACT

An apparatus for securing a package includes a flexible tear-resistant bag and an anchor system for securing the bag to a substrate. The bag includes a receptacle defining a package receiving space and a closure mechanism connected to the receptacle for selectively closing the receptacle. The anchor assembly includes a housing, a fastener, and an anchor securable to the substrate. The housing may be positioned in the package receiving space with the fastener extending through the housing and the receptacle and matingly received in the anchor. A door of the housing may be secured in a closed position to limit access to the fastener. In some embodiments, the bag of the apparatus may also be provided with an alarm system so if an unauthorized entry is attempted by cutting the tear-resistant bag the alarm system will emit an alerting signal.

13 Claims, 5 Drawing Sheets

(56) References Cited

U.S. PATENT DOCUMENTS

| | | | | |
|---|---|---|---|---|
| 6,155,715 | A | 12/2000 | Lake et al. | |
| 6,340,235 | B1 * | 1/2002 | Bryan | A45C 13/24 150/101 |
| 6,463,771 | B1 | 10/2002 | Judge | |
| 6,540,134 | B1 | 4/2003 | Rasche | |
| 6,597,283 | B2 | 7/2003 | Ramirez, Jr. | |
| 6,637,909 | B1 * | 10/2003 | Bryan | A45C 15/00 362/154 |
| 6,950,012 | B2 | 9/2005 | Ramirez, Jr. | |
| 7,122,763 | B1 | 10/2006 | Liu et al. | |
| 7,411,483 | B2 | 8/2008 | Ramirez, Jr. | |
| 7,916,003 | B2 | 3/2011 | Ramirez, Jr. | |
| 8,910,679 | B2 | 12/2014 | Avganim | |
| 9,364,112 | B2 | 6/2016 | Sundaresan | |
| 9,596,952 | B2 | 3/2017 | Mencel | |
| 9,630,757 | B1 | 4/2017 | Capous | |
| 2001/0045449 | A1 | 11/2001 | Shannon | |
| 2004/0090773 | A1 * | 5/2004 | Bryan | H02J 7/0044 362/156 |
| 2012/0269461 | A1 | 10/2012 | Proctor et al. | |
| 2013/0077896 | A1 | 3/2013 | Wiley et al. | |
| 2013/0186841 | A1 | 7/2013 | Johnson et al. | |
| 2014/0305828 | A1 | 10/2014 | Salvo | |
| 2016/0051073 | A1 | 2/2016 | Heinz et al. | |
| 2017/0074023 | A1 | 3/2017 | Peck et al. | |
| 2017/0286905 | A1 | 10/2017 | Richardson et al. | |
| 2017/0293883 | A1 | 10/2017 | Li et al. | |
| 2018/0116360 | A1 * | 5/2018 | Caroli | H04M 1/0202 |
| 2018/0146759 | A1 | 5/2018 | Godshaw et al. | |
| 2018/0162612 | A1 | 6/2018 | Bojic | |
| 2019/0224400 | A1 | 7/2019 | Wuppuluru | |

* cited by examiner

APPARATUS FOR SECURING A PACKAGE

CROSS-REFERENCE TO RELATED APPLICATIONS

This application is a continuation of U.S. Ser. No. 17/067,087, filed on Oct. 9, 2020; which is a continuation of U.S. Ser. No. 16/291,837, filed on Mar. 4, 2019, now U.S. Pat. No. 10,800,577; which claims benefit to U.S. Provisional Application No. 62/637,820, filed on Mar. 2, 2018, entitled "APPARATUS FOR SECURING A PACKAGE"; the entire contents of each being hereby expressly incorporated herein by reference.

BACKGROUND

The growth of online shopping and the increased efficiency of distribution and delivery systems have led to an increase in package deliveries. Even where products are not ordered using online methods, products are increasingly shipped from more centralized locations rather than being stocked at a larger number of widely distributed stores or warehouses. Customers order an increasing number of products and types of products for delivery to their home or business rather than visiting a local business in person to purchase the products.

Delivery of packages can be problematic, particularly to residential locations, for several reasons including: the recipient is not home or available to receive the package, packages left unattended may be subject to theft or environmental damage, package re-delivery is time consuming and costly, package return is costly and returned or undelivered packages often lead to unsatisfied customers. Package deliveries are often missed because no one is present to accept the package, because no one may answer the door to accept the package, because the recipient is at work, because the recipient is traveling, or for other reasons. If a package is left outside, it may not be picked up for an extended period if the recipient is traveling, is staying at another residence, and/or does not realize the package has been left. Shipping companies often leave door tags giving the recipient the option of scheduling a re-delivery or picking up the package or package at another location. Such options can be inconvenient, challenging, and frustrating for the recipient.

Recipients often try to plan orders ahead of time by estimating when the package containing the order will be delivered and attempting to coordinate delivery of the package with work or travel schedules. In addition, as automated and semi-automated methods of package shipping and delivery are explored, improved apparatuses, systems, and methods of package receipt will be necessary to realize the full advantages of these improved shipping and delivery methods.

It is the purpose of this disclosure to provide improved apparatuses and systems for delivery and receipt of packages to improve efficiencies, reduce costs for shipping companies, improve customer satisfaction, improve customer convenience, and support continued growth of e-commerce and online ordering activities. While many examples are described regarding delivery of packages to residential locations, the disclosed apparatuses and systems also apply to business locations, retail locations, and anywhere a package may be delivered. Even though many examples are described regarding delivery of packages, the disclosed apparatuses, systems, and methods may also be used when shipping a package and leaving it for pick up by a delivery service, shipping service, or courier.

DETAILED DESCRIPTION OF EXEMPLARY EMBODIMENTS

Figure 1:
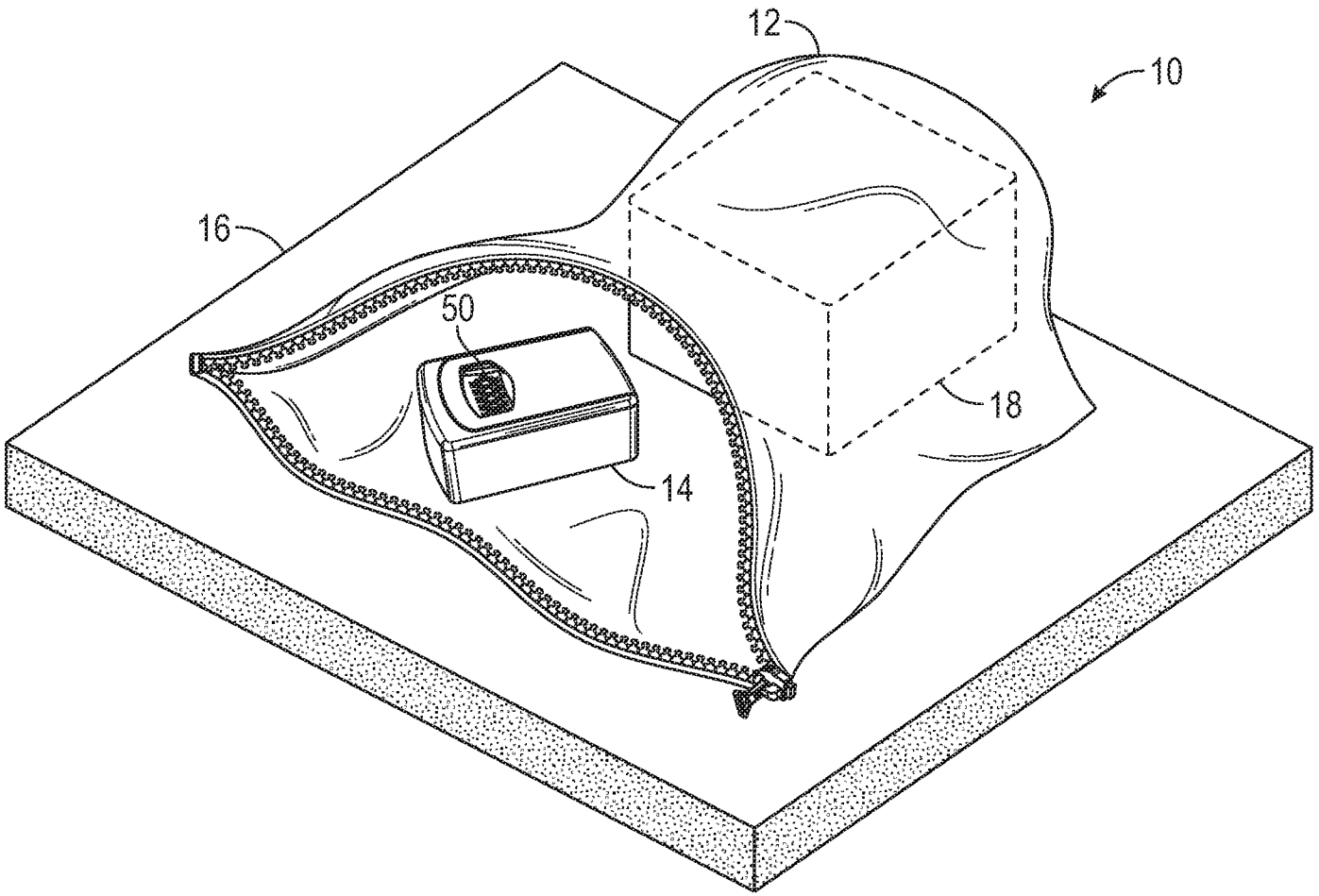
FIG. 1 is a partially cut away, perspective view of an apparatus for securing a package constructed in accordance with the inventive concepts disclosed herein.

Before explaining at least one embodiment of the disclosure, it is to be understood that the disclosure is not limited in its application to the details of construction, experiments, exemplary data, and/or the arrangement of the components in the following description or illustrated in the drawings unless otherwise noted.

The systems and methods as described in the present disclosure are capable of other embodiments or of being practiced or carried out in various ways. Also, it is to be understood that the phraseology and terminology employed is for description and should not be limiting.

This detailed description refers to the accompanying drawings. The same reference numbers in different drawings may identify the same or similar elements.

As used in the description herein, the terms "comprises," "comprising," "includes," "including," "has," "having," or any other variations thereof, should cover a non-exclusive inclusion. For example, unless otherwise noted, a process, method, article, or apparatus that comprises a list of elements is not necessarily limited to only those elements, but may also include other elements not listed or inherent to such process, method, article, or apparatus.

Further, unless stated to the contrary, "or" refers to an inclusive and not to an exclusive "or". For example, a condition A or B is satisfied by one of: A is true (or present) and B is false (or not present), A is false (or not present) and B is true (or present), and both A and B is true (or present).

In addition, use of the "a" or "an" are employed to describe elements and components of the embodiments herein. This is done merely for convenience and to give a general sense of the inventive concept. This description should be read to include one or more, and the singular also includes the plural unless it is meant otherwise. Further, use of the term "plurality" conveys "more than one" unless stated to the contrary.

As used herein, any reference to "one embodiment," "an embodiment," "some embodiments," "one example," "for example," or "an example" means that a particular element, feature, structure or characteristic described in connection with the embodiment is included in at least one embodiment. The appearance of the phrase "in some embodiments" or "one example" in various places in the specification is not necessarily all referring to the same embodiment, for example.

As used herein, the term "package" refers to any packages, parcel, box, or delivered item or items, including food delivery. The term "package" may include items delivered from a distance through a shipping company or items delivered directly by a local provider, such as a grocery delivery service from a local supermarket. As used herein, the term "package" may refer to boxes, packages, bags, envelopes, letters, papers, documents, gifts, delivered food, groceries, flowers, pharmaceuticals, books, magazines, newspapers, or any other item that might be delivered.

As used herein, the term "grommet" means any form of grommet, hard to cut metal ring or other suitable fabric reinforcing system or material.

Figure 2:
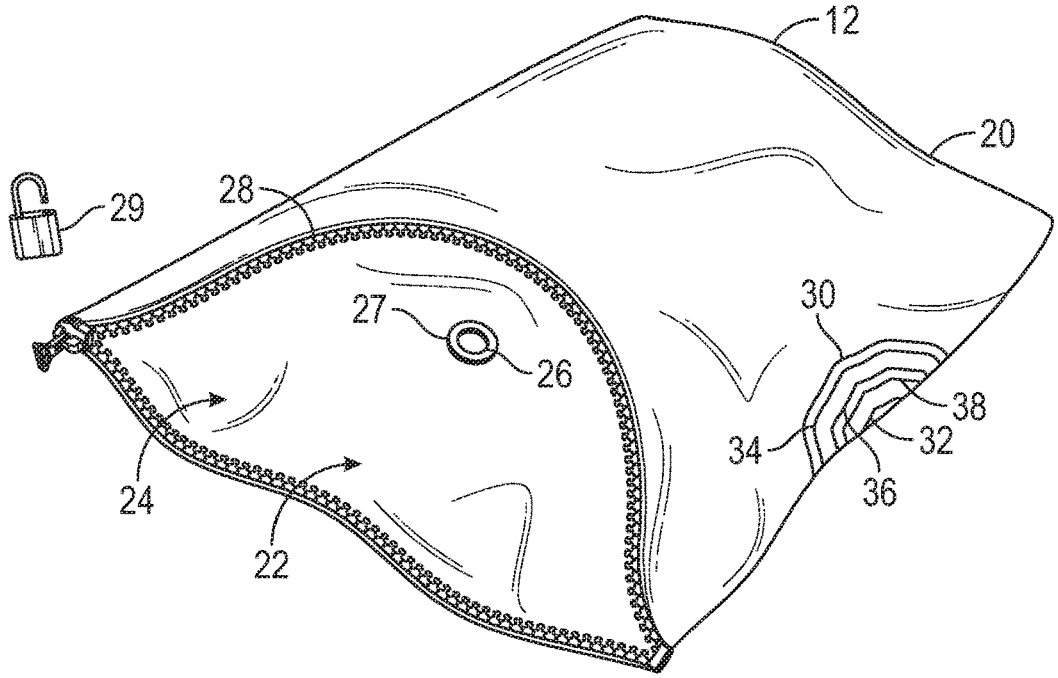
FIG. 2 is a partial cut away, perspective view of a bag of the apparatus of FIG. 1.
Figure 3:
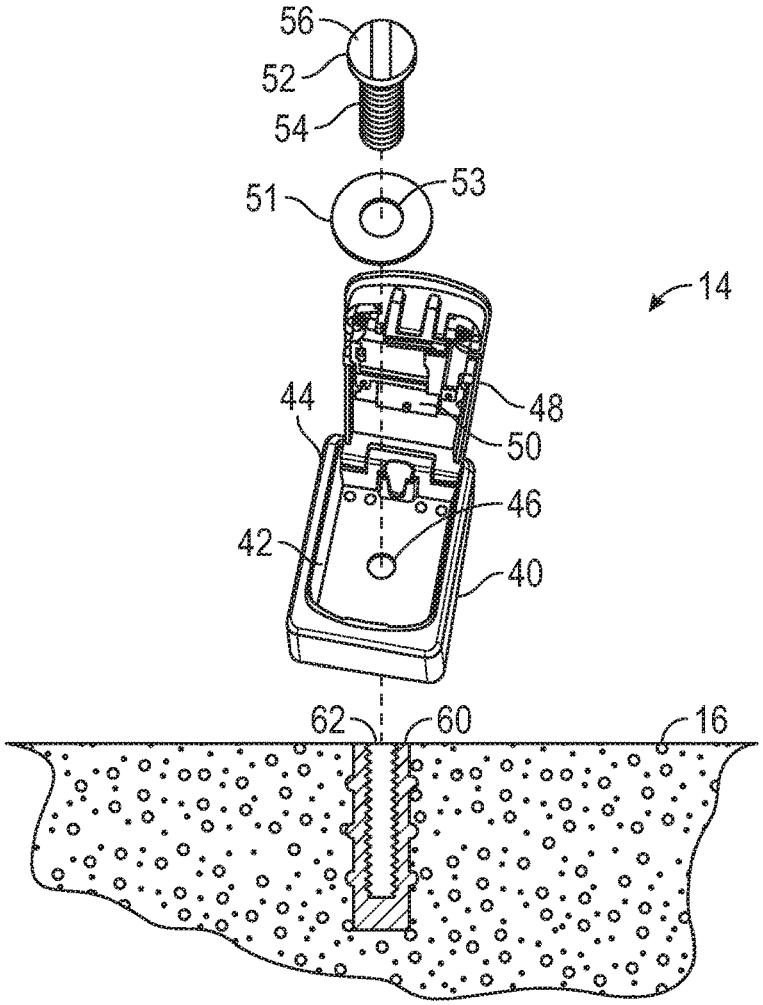
FIG. 3 is an exploded, perspective view of an anchor assembly of the apparatus of FIG. 1.

Referring now to the drawings, and more particularly to FIGS. 1-3, shown is an apparatus 10 for securing a package, such as package 18, constructed in accordance with the presently disclosed inventive concepts. The apparatus 10 includes a bag 12 and an anchor assembly 14 for securing the bag 12 to a substrate 16. It is contemplated that the substrate 16 to which the apparatus 10 is secured is a material such as, for instance, concrete, stone, brick, or wood. It is to be understood that the term "secured" as used herein refers to items being connected, attached, or affixed in any format without limitation.

The bag 12 has a flexible, tear-resistant receptacle 20 that defines a package receiving space 22. The tear-resistant receptacle 20 is provided with a first opening 24, a second opening 26, and a closure mechanism 28 connected to the flexible, tear-resistant bag 12 for selectively closing the first opening 24. The tear-resistant receptacle 12 may be provided with a grommet 27 for reinforcing the second opening 26.

The tear-resistant receptacle 20 may be provided with an outer layer of material 30 and an inner layer of material 32. The outer and inner layers of material 30 and 32 may be fabricated from any flexible material ordinarily utilized in constructing bags meant to be in an outdoor environment, such as vinyl and canvas, so the tear-resistant receptacle 12 provides the package 18 secured inside with protection from the elements.

The tear-resistant receptacle 12 further includes at least one layer of flexible, tear-resistant material interposed between the outer layer of material 30 and the inner layer of material 32. The flexible, tear-resistant material that forms the tear-resistant receptacle 20 can be fabricated from any flexible, lightweight material having a high tensile strength and a high cut resistance. A suitable tear-resistant material may be fabricated of a manmade, organic fiber sold under the trademark "KEVLAR" by E.I. DuPont de Nemours & Co., Inc.

The tear-resistant receptacle 20 is illustrated in FIG. 2 as including a first layer of tear-resistant material 34, a second layer of tear-resistant material 36, and a third layer of tear-resistant material 38. To increase penetration resistance of the tear-resistant receptacle 20, the pattern of fabric weave of the first layer of tear-resistant material 34 may be rotated approximately ninety degrees relative to the pattern of fabric weave of the second layer of tear-resistant material 36. Likewise, the pattern of fabric weave of the third layer of tear-resistant material 38 may be rotated approximately ninety degrees relative to the pattern of fabric weave of the second layer of tear-resistant material 36. The tear-resistant receptacle 20 may be sized, shaped, formed, adapted, or molded into any configuration necessary to adequately attached to the substrate 16 and cover and protect packages.

The closure mechanism 28 may be any closure mechanism for securing a receptacle known in the art. By way of non-limiting example, the closure mechanism 28 may be a lockable double-layer security zipper, such as disclosed in U.S. Pat. No. 8,793,847 issued Aug. 5, 2014, or the closure mechanism 28 may be provided with an integrated locking mechanism such as disclosed in U.S. Pat. No. 8,661,861 issued Mar. 4, 2014; each of these patents are hereby incorporated herein by reference in their entirety. Other exemplary integrated locking mechanisms may also be those used in security bags, such as the locking security bag model no. 7120D manufactured by Master Lock Company, LLC.

It will be appreciated that closure mechanisms are well known in the art. As such, no further description of the components, construction, or operation of the closure mechanism 28 is believed necessary for one skilled in the art to understand and implement the bag 12 of the present disclosure.

To secure the closure mechanism 28 when an integrated locking mechanism is not provided, the apparatus 10 for securing a package may be provided with a locking mechanism 29. The locking mechanism 29 may be any lock known in the art such as a padlock, combination lock, or cable lock, for instance, that pass through aligned openings in the lockable double-layer zipper to secure the closure mechanism 28 in a closed position.

In one embodiment, the locking mechanism 29 may be an electronic lock that may be opened using one or more close proximity electromagnetic communication devices, such as an NFC, RFID, or Bluetooth transceiver or by entering an access code, for instance. The electronic lock may be configured to grant selective access to the package receiving space 22 of the bag 12 to provide temporary access to one or more delivery services such as, for instance, United Parcel Service, U.S. Postal Service, or Fed Ex., to allow a delivery person to open the bag 12 to secure a package inside. When a delivery is scheduled, the user may provide a one-time-use access code, for instance, to the delivery service that allows the delivery person to open the electronic lock and access the package receiving space 22 of the bag 12.

Use of the electronic lock has the further advantage of allowing more than one package to be secured in the package receiving space 22. For instance, when delivery is expected from more than one delivery service on the same day, the user may provide temporary access to each delivery service. A first delivery service may secure a first package inside the bag 12. A second delivery service may deliver a second package by using an electronic device, for instance, to open the electronic lock and place the second package in the bag 12 with the first package and re-secure the bag 12.

The integrated locking mechanisms described above may be electronic locks which operate and provide the advantages as described herein.

Figure 4:
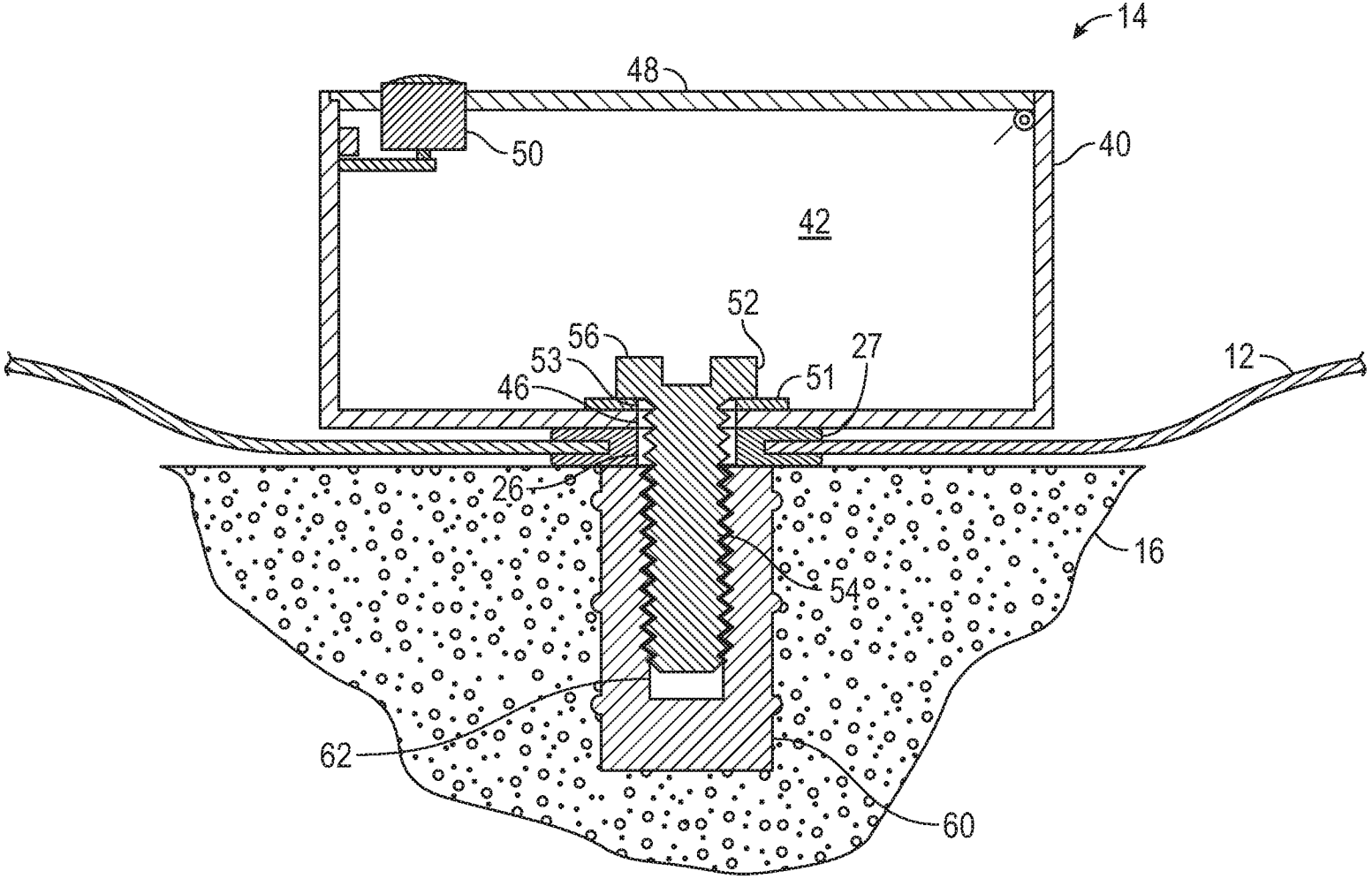
FIG. 4 is a cross-sectional view of the anchor assembly of FIG. 3 illustrating the bag secured to a substrate.

Referring now to FIGS. 3 and 4, the anchor assembly 14 includes a housing 40, a fastener 52, and an anchor 60. The anchor assembly 14 may further be provided with a washer 51.

The housing 40 of the anchor assembly 14 defines a cavity 42 and is provided with a first opening 44, a second opening 46, a door 48 for selectively closing the first opening 44, and a locking mechanism 50.

The locking mechanism 50 of the housing 40 selectively secures the door 48 of the housing 40 in a closed position relative to the housing 40. The locking mechanism 50 may be constructed in a conventional manner. It will be appreciated that locking mechanisms are well known in the art. No further description of the components, construction, or operation of the locking mechanism 50 is believed necessary for one skilled in the art to understand and implement the anchor assembly 14 of the present invention.

The fastener 52 is provided with a shaft 54 and a head 56. The fastener 52 may be constructed in a conventional manner. It will be appreciated that fasteners are well known in the art. No further description of the components, construction, or operation of the fastener 52 is believed necessary for one skilled in the art to understand and implement the anchor assembly 14 of the inventive concepts disclosed herein.

In embodiments of the anchor assembly 14 that include the washer 51, the head 56 of the fastener 52 may be positioned in contact with the washer 51 with the shaft 54 extending through an aperture 53 of the washer 51, the second opening 46 of the housing 40, and the second opening 26 of the tear-resistant receptacle 20.

The anchor 60 is provided with a recess 62 configured to matingly receive the shaft 54 of the fastener 52. The anchor 60 may be a type that is securable to exemplary substrates such as concrete, stone, brick, or wood, for instance. By way of non-limiting example and for illustration only, the anchor 60 in FIG. 3 is shown secured in a concrete slab forming substrate 16. Anchor 60 may be of a type that may be secured to the substrate 16 either during installation of the substrate 16 or retro-fit into an existing substrate using means known in the art. It will be appreciated that anchors are well known in the art. No further description of the components, construction, or operation of the anchor 60 is believed necessary for one skilled in the art to understand and implement the anchor assembly 14 of the present invention.

To use the apparatus 10, the anchor 60 is secured in the substrate 16. When a package is expected, a user secures the bag 12 to the substrate 16 using the anchor assembly 14. The housing 40 of the anchor assembly 14 is positioned in the package receiving space 22 of the tear-resistant receptacle 20 with the second opening 46 of the housing 40 aligned with the second opening 26 of the tear-resistant receptacle 20 and the recess 62 of the anchor 60. The head 56 of the fastener 52 is positioned in the cavity 42 of the housing 40 with the shaft 54 extending through the second opening 46 of the housing 40 and the second opening 26 of the tear-resistant receptacle 20 and matingly received in the recess 62 of the anchor 60 to secure the bag 12 to the substrate 16. Once the bag 12 has been secured to the substrate 16, the door 48 of the housing 40 is closed and locked to limit access to the head 56 of the fastener 52. When a package is delivered, the delivery person places the package in the package receiving space 22 and closes the first opening 24 by securing the closure mechanism 28.

When the apparatus 10 is not in use, the bag 12 and the anchor assembly 14 (minus the anchor 60 secured in the substrate 16) may be stored, for instance, in the house or garage. When the apparatus 10 is not in use the only element that may remain exposed is the anchor 60 secured to the substrate 16.

Figure 5:
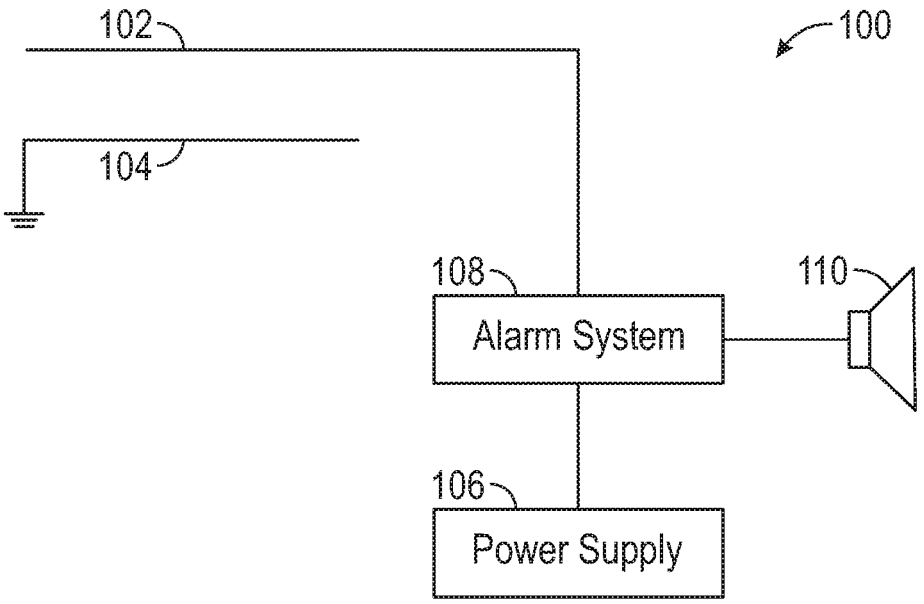
FIG. 5 is a schematic diagram of an electrical circuit utilized in the apparatus.

Referring now to FIG. 5, shown is an alarm assembly 100. The alarm assembly 100 is provided with a first conductor plate 102, a second conductor plate 104, a power supply 106, and an alarm system 108 which includes an alerting signal emitter, such as a speaker 110. The alarm system 108 can be any conventional battery-powered alarm system such as those used for automobiles, for instance. The power supply 106 may be any conventional battery such as a car battery, for instance. The power supply 106 may be located anywhere appropriate within the package receiving space 22 or even within the housing 40, making it difficult for a would-be thief or vandal to disable the alarm system 108.

Figure 6:
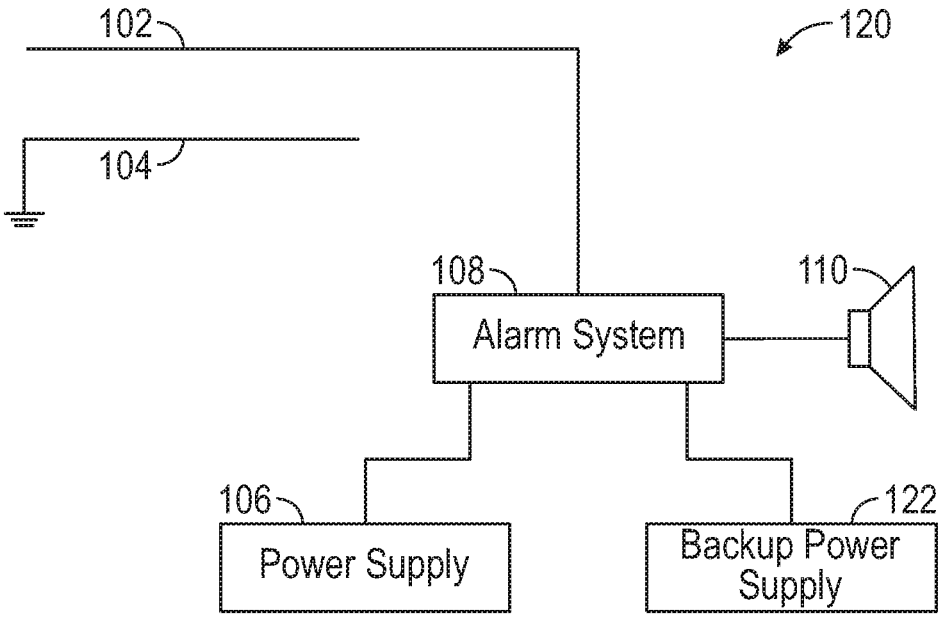
FIG. 6 is a schematic diagram of another version of an electrical circuit which can be utilized in the apparatus.

FIG. 6 illustrates another embodiment of an alarm assembly 120 similar to the alarm assembly 100, except that the alarm assembly 120 has a backup power supply 122, such as a 12 volt battery, to provide an element of redundancy if disconnection occurs or malfunction of the power supply 106. The backup power supply 122 may be located anywhere appropriate within the package receiving space 22 or even within the housing 40, making it difficult for a would-be thief or vandal to disable the alarm system 108 of the apparatus 10 for securing a package.

Each of the first and second conductor plates 102 and 104 of the alarm assembly 100 is fabricated of a sheet of flexible, electric conducting material, such as aluminum or copper. To increase the durability of the first and second conductor plates 102 and 104 to ensure that the first and second conductor plates 102 and 104 are sufficiently durable to withstand repeated folding and unfolding from the opening and closing of the bag 12, each of the first and second conductor plates 102 and 104 may be coated with a protective film. A suitable protective film is sold under the trademark MYLAR by E.I. DuPont de Nemours & Co., Inc. A suitable material for use as the first and second conductor plates 102 and 104 is commercially available from Arlon Engineered Laminates and Coating, 199 Amaral Street, East Providence, R.I.

The first and second conductor plates 102 and 104 are sized, shaped, adapted, formed, or molded to substantially correspond to the size and shape of the outer and inner layers of material 30 and 32 and the first, second and third layers of tear resistance material 34, 36, and 38. The first and second conductor plates 102 and 104 are preferably assembled with one of the first, second, or third sheets of tear resistance material 34, 36, and 38 positioned between the first and second conductor plates 102 and 104 to electrically insulate the first conductor plate 102 from the second conductor plate 104. However, the protective film of the first and second conductor plates 102 and 104 can be utilized as an insulator which allows the first and second conductor plates 102 and 104 to be positioned adjacent to each other at low voltage levels without electrically shorting. It will also be appreciated that any other suitable insulating material can electrically insulate the first conductor plate 102 from the second conductor plate 104.

With the first and second conductor plates 102 and 104 incorporated into the tear-resistant receptacle 20, the first conductor plate 102 is electrically isolated from ground and electrically connected to the alarm system 108, while the second conductor plate 104 is electrically grounded. The first and second conductor plates 102 and 104 are electrically insulated so upon an electrical conducting implement, such as a knife or screwdriver, piercing the outer layer of material 30, the first conductor plate 102, and the first layer of tear-resistant material 34, and contacting the second conductor plate 104, an electrical connection is established between the first conductor plate 102 and the second conductor plate 104 causing the alarm system 108 to emit an alerting signal via the speaker 110.

If an unauthorized entry is attempted by cutting the tear-resistant receptacle 20, the person attempting such entry will discover that the apparatus 10 for securing a package is difficult to penetrate with any sharp object, almost impossible to tear or cut, and the alarm system 108 will sound. If the would-be thief attempts to disconnect the power supply 106 to disable the alarm assembly 108 it will be to no avail because the apparatus 10 for securing a package can also include the backup power supply 122. Because the first conductor plate 102 is connected to the positive terminal of the power supply 106, if the thief is electrically grounded, the alarm system 108 will emit an alerting signal when the implement contacts the first conductor plate 102 without the necessity of contacting the second conductor plate 104.

Figure 7:
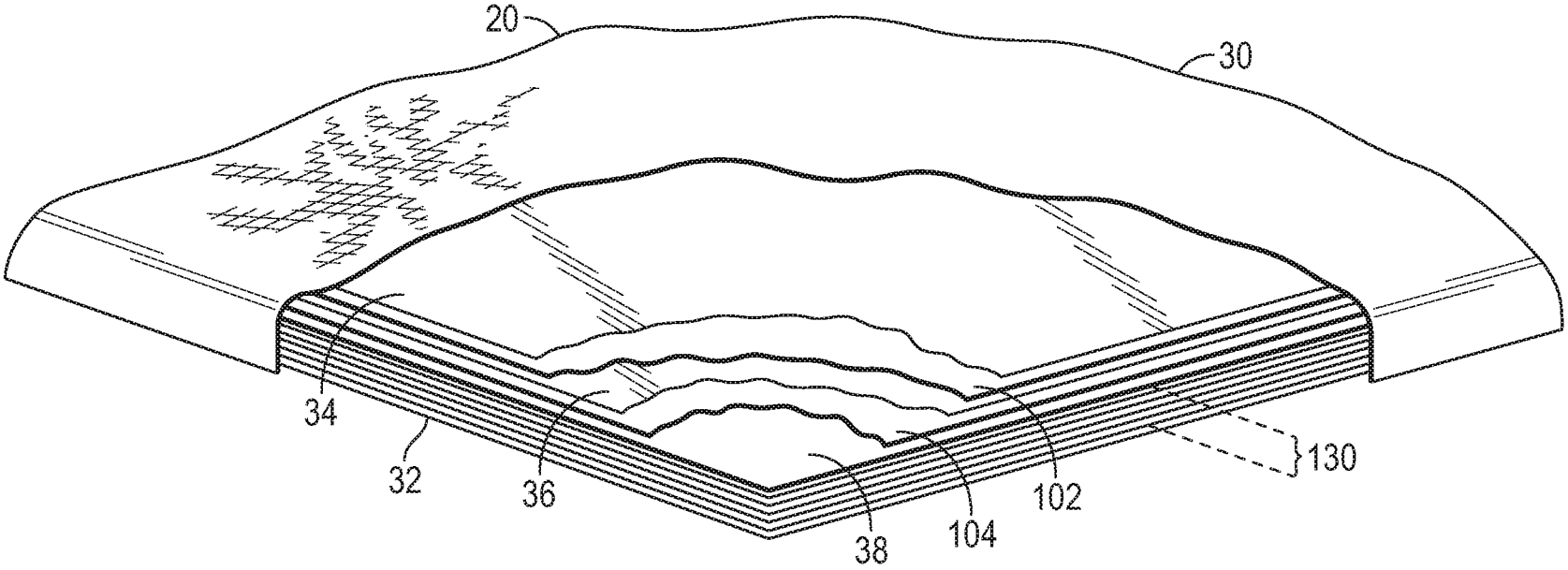
FIG. 7 is a partial cut away, perspective view of another embodiment of a receptacle of the apparatus for securing a package of FIG. 1 constructed in accordance with the inventive concepts disclosed herein.

While the apparatus 10 for securing a package has been described above as having two layers of conducting plates 102 and 104 and three layers of tear-resistant material 34, 36, and 38, those skilled in the art will recognize that additional layers of tear-resistant material can be removed or added to the apparatus 10 for securing a package to alter its resistance to tear. For example, as illustrated in FIG. 7, a sufficient number of layers of tear-resistant material can be added to make the tear-resistant receptacle 20 substantially impenetrable. These additional layers are identified by the reference numeral 130 in FIG. 7.

Those skilled in the art will also recognize that an apparatus for securing a package can be constructed that includes the tear-resistant properties discussed above, but does not include the alarm assembly 100 or 120. Similarly, an apparatus for securing a package can be constructed that includes the alarm assembly 100 or 120, but which is not tear-resistant. And those skilled in the art will readily recognize that while the apparatus 10 for securing a package has been described with a bag 12 forming the tear-resistant receptacle 20, a tear-resistant receptacle of the apparatus 10 for securing a package can readily be sized, shaped, and adapted into a variety of sizes and shapes to define the package receiving space 22.

From the above description, the inventive concepts disclosed are well adapted to carry out the objects and to attain the advantages mentioned and those inherent in the inventive concepts disclosed. While exemplary embodiments of the inventive concepts disclosed have been described for this disclosure, it will be understood that numerous changes may be made which will readily suggest themselves to those skilled in the art and which are accomplished within the scope and coverage of the inventive concepts disclosed and claimed.

What is claimed is:

1. An apparatus for securing a package, comprising:

a bag defining a package receiving space and having at least one opening for accessing the package receiving space, the bag formed of an outer layer of flexible material, an inner layer of flexible material, and at least one layer of flexible, tear-resistant material; the at least one opening being selectively closable; and an alarm assembly comprising:

a first conductor plate fabricated of a flexible, electrically conductive material, the first conductor plate interposed between the outer layer of flexible material and the inner layer of flexible material;

a second conductor plate fabricated of a flexible, electrically conductive material, the second conductor plate interposed between the outer layer of flexible material and the inner layer of flexible material electrically insulated from the first conductor plate;

a power source positioned in the package receiving space of the bag; and an alarm system having an alerting signal emitter, the alarm system electrically connected to the power source and at least one of the first conductor plate and the second conductor plate so upon an electrical conducting implement piercing the first conductor plate and contacting the second conductor plate an electrical connection is established between the first conductor plate and the second conductor plate causing the alarm system to emit an alerting signal.

2. The apparatus for securing a package of claim 1 further comprising an anchor assembly connected to the bag.

3. The apparatus for securing a package of claim 2 wherein the bag has a second opening, and wherein the anchor assembly comprises:

a housing defining a cavity and having a first opening, a second opening, and a door for selectively closing the first opening of the housing, the housing positionable in the package receiving space and over the second opening of the bag with the second opening of the housing aligned with the second opening of the bag;

an anchor securable to a substrate;

a fastener at least partially positionable in the cavity of the housing and connectable to the anchor via the second opening of the housing and the second opening of the bag so the bag is secured to the substrate when the anchor is secured to the substrate and the fastener is connected to the anchor; and a locking mechanism associated with the door in a way to selectively secure the door in a closed position relative to the first opening of the housing to limit access to the fastener.

4. The apparatus for securing a package of claim 3 wherein the at least one layer of flexible, tear-resistant material further comprises a plurality of layers of flexible, tear-resistant material.

5. The apparatus for securing a package of claim 4 wherein each layer of flexible, tear-resistant material has a fabric pattern weave and wherein the fabric pattern weave of each layer of flexible, tear-resistant material is oriented substantially ninety degrees relative to an adjacent layer of flexible, tear-resistant material.

6. The apparatus for securing a package of claim 5 wherein each layer of flexible, tear-resistant material is fabricated of KEVLAR.

7. The apparatus for securing a package of claim 3 wherein the bag further comprises a grommet reinforcing the second opening.

8. An apparatus in combination with a package, the apparatus comprising:

a bag anchored to a substrate, the bag defining a package receiving space and having at least one opening for accessing the package receiving space, the package disposed in the package receiving space with the at least one opening closed, the bag formed of an outer layer of flexible material, an inner layer of flexible material, and at least one layer of flexible, tear-resistant material; and an alarm assembly comprising:

a first conductor plate fabricated of a flexible, electrically conductive material, the first conductor plate interposed between the outer layer of flexible material and the inner layer of flexible material;

a second conductor plate fabricated of a flexible, electrically conductive material, the second conductor plate interposed between the outer layer of flexible material and the inner layer of flexible material electrically insulated from the first conductor plate;

a power source supported by the bag; and an alarm system having an alerting signal emitter, the alarm system electrically connected to the power source and at least one of the first conductor plate and the second conductor plate so upon an electrical conducting implement piercing the first conductor plate and contacting the second conductor plate an electrical connection is established between the first conductor plate and the second conductor plate causing the alarm system to emit an alerting signal.

9. The combination of claim 8 wherein the bag has a second opening, and wherein the bag is anchored to the substrate with an anchor assembly comprising:

a housing defining a cavity and having a first opening, a second opening, and a door for selectively closing the first opening of the housing, the housing positionable in the package receiving space and over the second opening of the bag with the second opening of the housing aligned with the second opening of the bag;

an anchor secured to the substrate;

a fastener at least partially positionable in the cavity of the housing and connected to the anchor via the second opening of the housing and the second opening of the bag so the bag is secured to the substrate; and a locking mechanism associated with the door in a way to selectively secure the door in a closed position relative to the first opening of the housing to limit access to the fastener.

10. The combination of claim 9 wherein the at least one layer of flexible, tear-resistant material further comprises a plurality of layers of flexible, tear-resistant material.

11. The combination of claim 10 wherein each layer of flexible, tear-resistant material has a fabric pattern weave and wherein the fabric pattern weave of each layer of flexible, tear-resistant material is oriented substantially ninety degrees relative to an adjacent layer of flexible, tear-resistant material.

12. The combination of claim 11 wherein each layer of flexible, tear-resistant material is fabricated of KEVLAR.

13. The combination of claim 11 wherein the bag further comprises a grommet reinforcing the second opening.

* * * * *